US005436791A

United States Patent [19]

Turano et al.

[11] Patent Number: 5,436,791

[45] Date of Patent: Jul. 25, 1995

[54] PERFORATING GUN USING AN ELECTRICAL SAFE ARM DEVICE AND A CAPACITOR EXPLODING FOIL INITIATOR DEVICE

[75] Inventors: Andy Turano, Wallingford; Carmelo A. Aresco, Middletown, both of Conn.

[73] Assignee: Raymond Engineering Inc., Middletown, Conn.

[21] Appl. No.: 192,684

[22] Filed: Feb. 7, 1994

Related U.S. Application Data

[63] Continuation-in-part of Ser. No. 129,857, Sep. 29, 1993.

[51] Int. Cl.[6] ..... F23Q 3/00

[52] U.S. Cl. ..... 361/253; 102/218; 89/115; 175/2

[58] Field of Search ..... 102/200, 206, 207, 209, 102/218, 221; 361/247, 248, 251, 253, 254, 252; 89/1.15; 175/2

[56] References Cited

U.S. PATENT DOCUMENTS

| | | | |
|---|---|---|---|
| 4,307,663 | 12/1981 | Stonestrom . | |
| 4,422,381 | 12/1983 | Barrett . | |
| 4,502,096 | 2/1985 | Malone | 361/308 |
| 4,517,497 | 5/1985 | Malone | 361/251 |
| 4,538,088 | 8/1985 | Malone . | |
| 4,590,536 | 5/1986 | Gerry | 361/253 |
| 4,592,280 | 6/1986 | Shores . | |
| 4,602,565 | 7/1986 | MacDonald et al. | 102/202.7 |
| 4,632,034 | 12/1986 | Colle Jr. . | |
| 4,640,370 | 2/1987 | Wetzel | 89/1.15 |
| 4,662,281 | 5/1987 | Wilhelm et al. . | |
| 4,716,832 | 1/1988 | Sumner . | |
| 4,762,067 | 8/1988 | Barker et al. . | |
| 4,895,218 | 1/1990 | Chen et al. | 89/1.15 |
| 5,088,413 | 2/1992 | Huber et al. | 102/202.5 |
| 5,094,167 | 3/1992 | Hendley, Jr. | 89/1.15 |
| 5,095,801 | 3/1992 | Lopez de Cardenas | 89/1.15 |
| 5,159,146 | 10/1992 | Carisella et al. | 89/1.15 |
| 5,347,929 | 9/1994 | Lerch et al. | 102/202.14 |

*Primary Examiner*—Jeffrey A. Gaffin

*Attorney, Agent, or Firm*—Fishman, Dionne & Cantor

[57] ABSTRACT

A perforating gun using an electrical safe arm device and a capacitor exploding foil initiator device. The capacitor exploding foil initiator device having a capacitor connected in parallel to a bleed resistor which are connected across an exploding foil initiator by an overvoltage gap switch. When a voltage of the capacitor reaches a breakdown voltage of the switch, the energy stored in the capacitor is discharged through the switch to the exploding foil initiator which initiates a detonator cord thereby detonating the shaped charges of the perforating gun.

25 Claims, 3 Drawing Sheets

PERFORATING GUN USING AN ELECTRICAL SAFE ARM DEVICE AND A CAPACITOR EXPLODING FOIL INITIATOR DEVICE

CROSS REFERENCE TO RELATED APPLICATION

This is a continuation-in-part application of U.S. Patent application Ser. No. 129,857 filed Sep. 29, 1993 entitled CAPACITOR EXPLODING FOIL INITIATOR DEVICE.

BACKGROUND OF THE INVENTION

The present invention relates generally to the field of explosives and more particularly to means, known as detonators, used to detonate shaped charges of a perforating gun. More particularly, the present invention relates to a capacitor exploding foil initiator device for detonating shaped charges of a perforating gun.

A common method of completing a well is to set a casing through the oil-bearing formation and cement it. In this well known method, after the casing string is run, cement is pumped down the inside of the casing. The cement flows through the bottom opening in the casing and starts up the annular space between the outside of the casing and the wall of the well (or bore hole). Pumping of the cement continues until the cement fills the annular space. Then a plug is forced down the inside of the casing by a displacement fluid (e.g., salt water) and the cement is allowed to harden. Once the well has been completed, as described above, access to the oil-bearing portion of the formation must be provided, typically by perforating the casing and the cement at selected locations. A perforating gun is commonly employed to provide these perforations. The perforating gun is device fitted with shaped charges or bullets that is lowered into the inside of the casing at a selected depth and fired to create penetrating holes (i.e., perforations) in the casing, cement and formation. The formation fluids (e.g., oil) flow out of the reservoir therein through the perforations and into casing.

Detonation of these shaped charges (i.e., a secondary explosive) is initiated by devices using a primary explosive. Such devices include: detonators (e.g., blasting caps); exploding bridge wire devices; and resistor bridges.

It is well known that the passage of an electric current through a conductor generates a certain amount of heat, the amount of heat varying directly with the resistance of the conductor and with the square of the current. This phenomenon is relied upon in fusible links that are installed in electrical circuits to prevent the flow of more than a predetermined amount of current in such a circuit. When the predetermined flow is exceeded, the heat melts the fusible link so that the circuit is broken. If a sufficient current is passed through the link in a small period of time, the link is not only melted but may be vaporized. If the fusible link is enclosed in a small space the vaporizing of the link can increase the pressure in that space.

The blasting caps include a heat sensitive primary explosive set off by an electrical resistance heated by the passage of an electric current through the resistance. The exploding bridge wire devices detonate a primary explosive using a relatively low resistance bridge extending between conductors and through which a relatively high current is passed so that the bridge portion is not only heated to its melting point but is heated so much that it vaporizes and literally explodes to provide a shock wave to detonate the primary explosive. While such a system can use a primary explosive that is much less sensitive to heat and shock than a secondary explosive, there are still a distressing number of accidents that occur when the primary explosive is prematurely detonated. While less sensitive explosives have heretofore been available, it has been difficult to cause the detonation of such explosives at a selected time.

Recently, it has been proposed to detonate these more stable explosives by an electrical means of some sort that creates a sudden pressure to shear a film and form a disk or flyer which is then impacted against the explosive material.

In the construction of such a detonator, it is important that the explosive material be properly supported and sealed against the admission of materials such as moisture that would tend to deteriorate it. This is particularly important when the detonator is used in environments, such as deep wells, where the ambient pressures can become very high. It is also important that the physical construction be such that the flyer has sufficient kinetic energy imparted to it to insure the detonation of the explosive.

One such example is disclosed in U.S. Pat. No. 4,602,565 (which is incorporated herein by reference) wherein an exploding foil detonator uses an explosive that is detonated by a flyer that is sheared form a sheet or film and propelled through a barrel to impact the explosive. The flyer is sheared from the sheet by the pressure generated when an electrical conductor adjacent the sheet is vaporized by the sudden passage of a high current (as by the discharge of a capacitor) through it. The explosive is sealed against moisture, and the mechanical configuration of the detonator is such as to take full advantage of the kinetic energy of the flyer.

As is typical in the prior art, the capacitor is in a circuit with the foil detonator and a normally open switch. When it is desired to arm the system, the capacitor is charged, e.g., to 3000 volts; when it is desired to initiate the explosion, the switch is closed and the capacitor discharges through the foil vaporizing the same. A high resistance bleed resistor connected across the capacitor is used to bleed off the charge on the capacitor in the event that the latter is charged but then not discharged into the load.

Premature explosion of the secondary explosive has occurred as a result of unintended detonation of the primary explosive (used to detonate the secondary explosive) resulting in loss of life and equipment. Accordingly, a need exist for a more reliable means for initiating the secondary explosive.

SUMMARY OF THE INVENTION

The above-discussed and other problems and deficiencies of prior an are overcome or alleviated by the perforating gun using an electrical safe arm device and a capacitor exploding foil initiator device of the present invention. In accordance with the present invention, the capacitor exploding foil initiator device comprises a low inductance capacitor connected in parallel to a bleed resistor which are connected across an exploding foil initiator by an over-voltage gap switch. A high voltage (e.g., 3000 volts) is applied to the capacitor through a connector pin. When the voltage of the capacitor reaches the breakdown voltage of the switch, the energy stored in the capacitor is then discharged through the switch into the exploding foil initiator. The exploding foil initiator is preferably a flat polyimide substrate having copper-cladding with a pre-etched copper bridge dimension. The discharge of energy through the bridge results in a vaporization of the copper foil and a polyimide flyer is then accelerated toward a HNS (hexanitrostilbene) explosive pellet (preferably HNS-IV). The velocity of the flyer propagates a shock wave through the HNS explosive which causes detonation. HNS requires a very high shock wave with a short time duration to cause detonation. This detonation, in turn, initiates the detonation cord in the perforating gun thereby detonating the shaped charges in the perforating gun which causes the perforations in the casing, cement and formation.

The above-discussed and other features and advantages of the present invention will be appreciated and understood by those of ordinary skill in the art from the following detailed discussion and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 1:
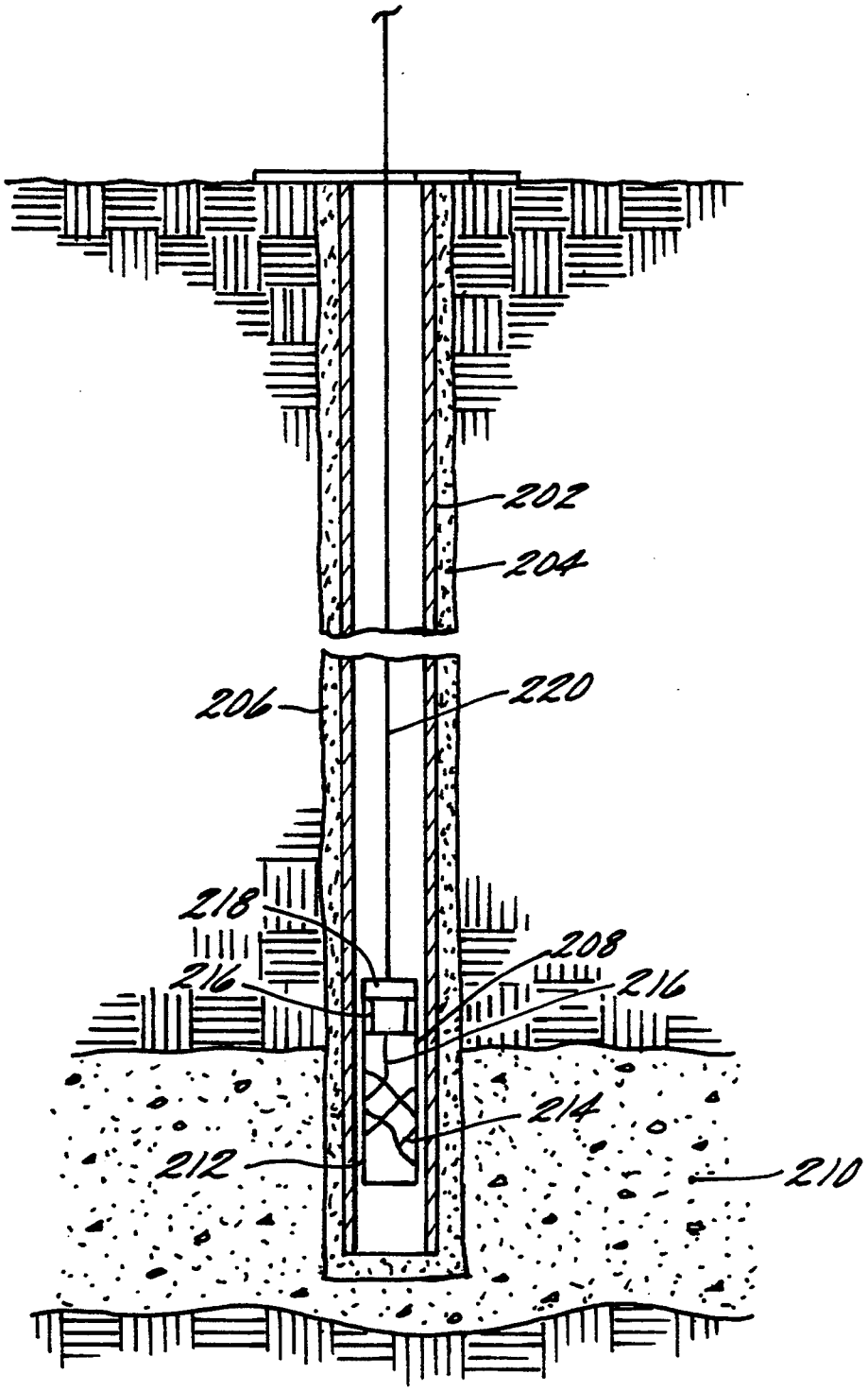
FIG. 1 is a cross sectional side elevation diagrammatic view of a perforating gun in a well bore, the perforating gun employing an electronic safe arm device and a capacitor exploding foil initiator device in accordance with the present invention.

Referring to FIG. 1, a well bore 200 has a casing 202 therein, an annular opening 204 between the wall of well bore 200 and the outer surface of casing 202 is filled with cement 206, in other words, well bore 200 is completed. A perforating gun 208 has been lowered into casing 202 to a depth where access to the formation is desired (i.e., an oil-bearing layer 210 of the formation). Perforating gun 208 is a well known wire line device for creating perforations in the casing, cement and formation to allow formation fluids (e.g., oil) to flow out of the reservoir in layer 210 through these perforations and into casing 202. Perforating gun 208 comprises a support structure 212 having a plurality of shaped charges 214 mounted thereto as is well known. Shaped charges 214 are interconnected by a detonation cord 216 also as is well known. Detonation cord 216 is connected at one end thereof to a detonator module 216 which is connected to an electronics and power supply module 218. A wire line 220 is connected to and supports perforating gun 208 as is known. Wire line 220 includes electrical conductors for providing electrical signals from the surface downhole to perforating gun 208.

Figure 2:
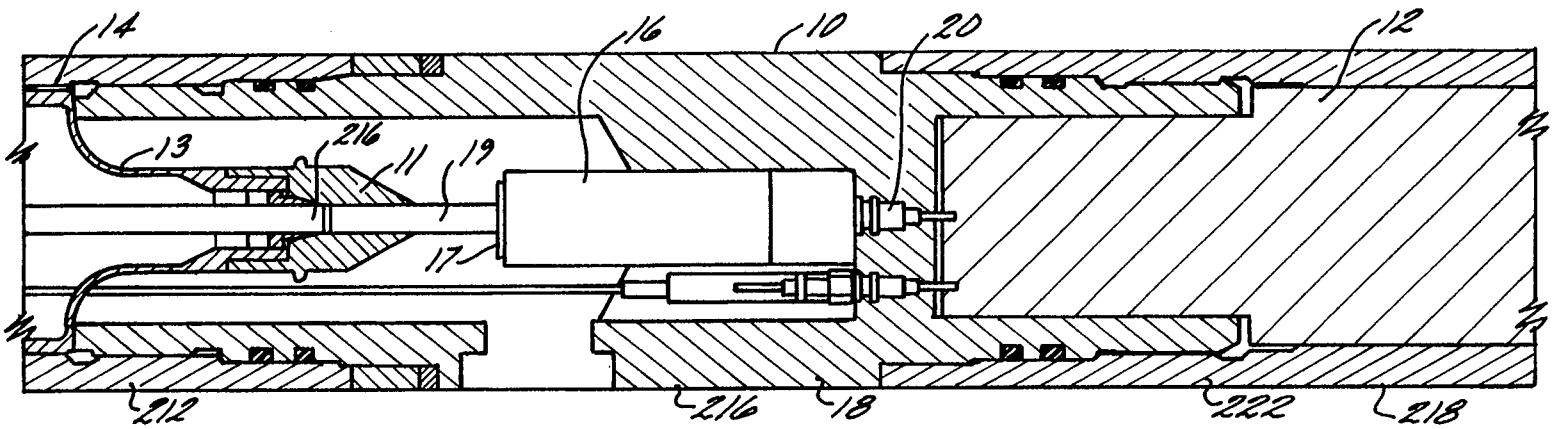
FIG. 2 is a partial cross section elevational view of the perforating gun of FIG. 1.

Referring to FIG. 2, in accordance with the present invention detonator module 216 comprises a capacitor exploding foil initiator device 16 disposed within a housing 18. Electronics and power supply module 218 comprises an electronic safe arm device 12 disposed within a housing 222 and a high voltage power supply. Housings 18 and 222 are connected by a rotary connection. Housing 18 and structure 212 are also connected by a rotary connection. Electrical connection between capacitor exploding foil initiator device 16 and electronic safe arm device 12 comprises a pin 20.

Structure 212 includes a holding mount 11 and spring assembly 13 which secure detonating cord 216 firmly against a surface 17 of capacitor exploding foil initiator device 16 for maintaining explosive propagation from capacitor exploding foil initiator device 16 to detonating cord 216. The tip or end of detonating cord 216 includes a booster charge 19 for proper ignition.

Figure 3A:
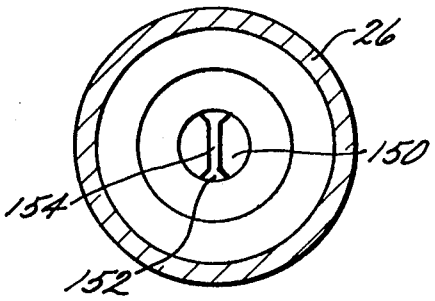
FIG. 3A is a cross sectional view through the line 3A—3A in FIG. 3.
Figure 3:
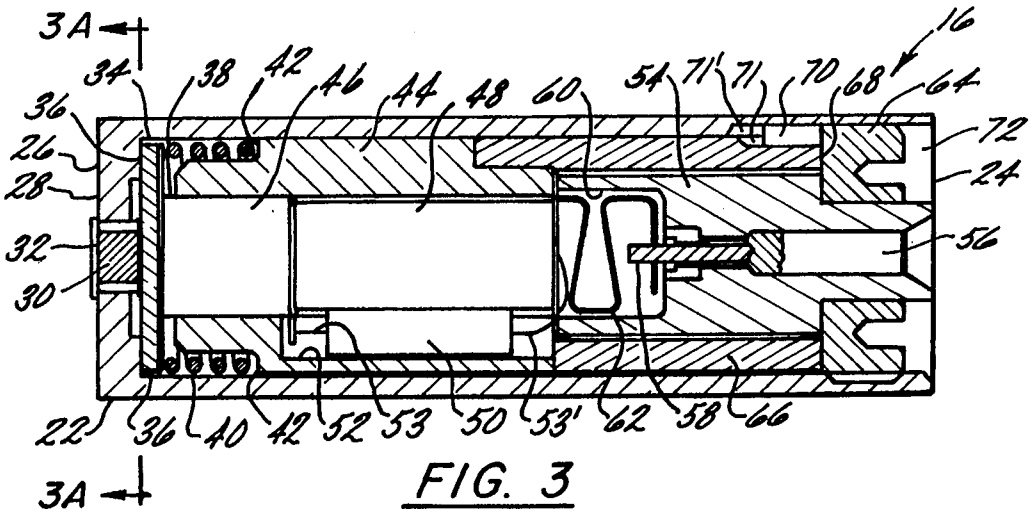
FIG. 3 is a cross section elevational view of the capacitor exploding foil initiator of FIG. 2.

Referring to FIG. 3, capacitor exploding foil initiator device 16 comprises a generally cylindrical external housing 22 having an open end 24 and a partially closed end 26 with a central opening 28. A pellet assembly 30 is disposed in opening 28 with a disk 32 closing off opening 28. Pellet 30 is preferably a HNS explosive pellet and more preferably a HNS-IV explosive pellet. A printed wiring board assembly 34 (i.e., an exploding foil initiator) is disposed within housing 22 and is supported on one side by a shoulder 36 of housing 22. The opposing side of assembly 34 is insulated by an insulating layer 38. Assembly 34 is biased against shoulder 36 by a spring 40 compressed between layer 38 and a shoulder 42 of an internal housing 44. Housing 44 is open at both ends thereof.

An over-voltage gap switch 46 is disposed within housing 44 at one end thereof adjacent insulating layer 38. Switch 46 may be of the type described in U.S. Pat. No. 4,538,088, which is incorporated herein by reference or any other suitable known switch which will make an electrical connection (i.e., switch closure) when a selected voltage (i.e., breakdown voltage) is attained. A capacitor 48 is disposed adjacent switch 46 within housing 44 at the other end thereof. Capacitor 48 is preferably a low-inductance capacitor capable of retaining a charge on the order of approximately 3000 volts, for example, the low-inductance capacitor described in U.S. Pat. No. 4,502,096, which is incorporated herein by reference. A bleed resistor 50 is mounted adjacent capacitor 48 within a recess 52 of housing 44. Resistor 50 includes leads 53 and 53' which electrically connect resistor 50 across capacitor 48. Lead 53' and the corresponding lead of capacitor 48 are in electrical contact with housing 44 which serves as case ground.

A contact assembly 54 is disposed at the open end 24 of housing 22. Assembly 54 includes a contact 56 (i.e., socket) for accepting pin 20 (described hereinbefore). A tab 58 extends from assembly 54 into a cavity 60 thereof. Tab 58 includes an eyelet wherein a conductive wire 62 is attached, preferably soldered. Wire 62 provides electrical connection between contact 56 and capacitor 48 (i.e., the corresponding lead of the capacitor connected to resistor lead 53).

A nut spanner 64 bears against a spacer 66 and a shoulder 68 of assembly 54 to secure the components in housing 22. A dowel pin 70 is disposed within recesses 71 and 71' of spacer 66 and housing 22 respectively to maintain alignment of these components. Spacer 66 bears against one end of housing 44 and is disposed about assembly 54. An opening in nut spanner 64 is filled with a compound 72 to seal the device and provide a flat outer surface.

Figure 4:
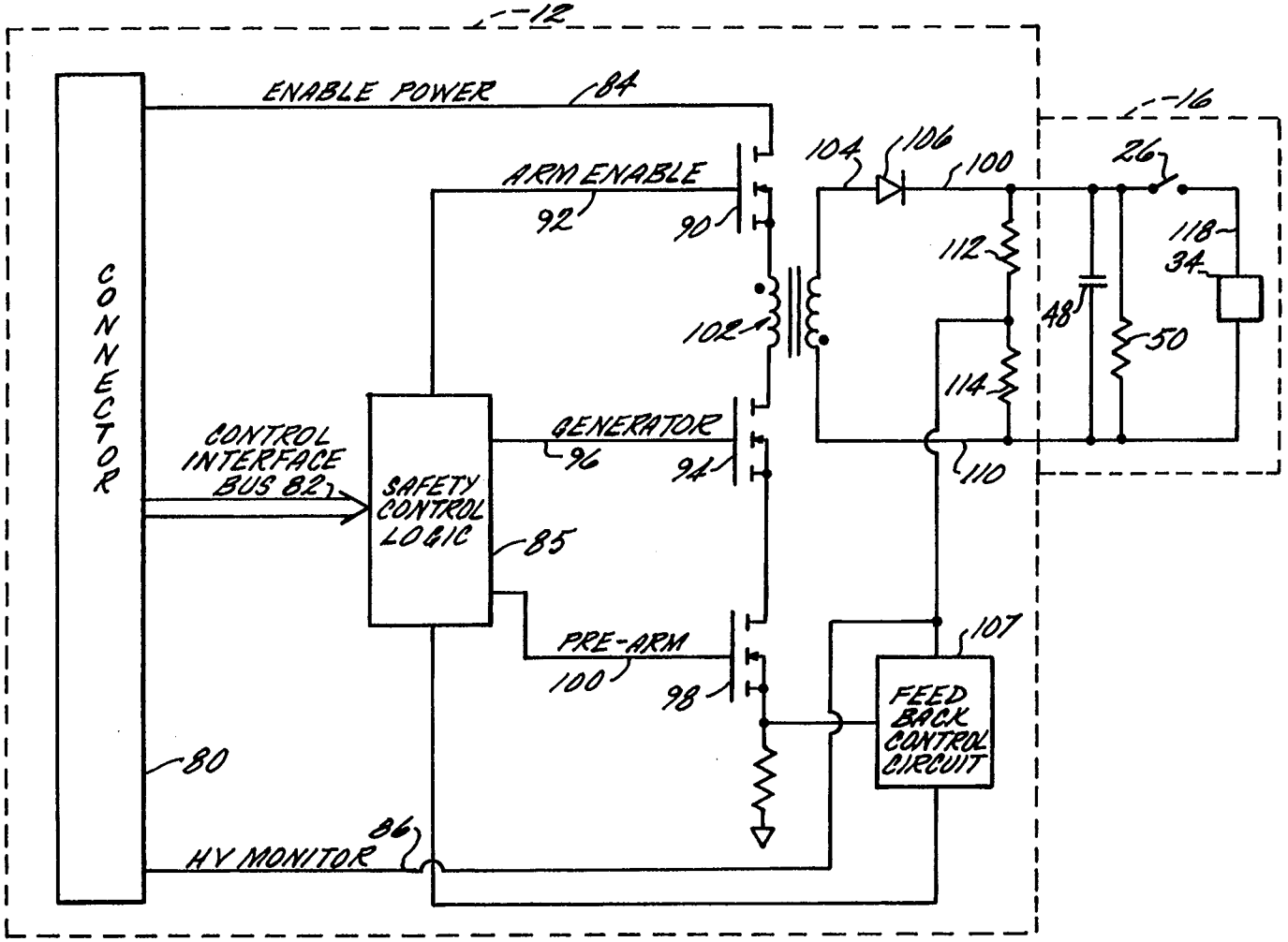
FIG. 4 is an electrical schematic diagram of the safe arm device and the capacitor exploding foil initiator device of FIG. 2.

Referring also to FIG. 4, wherein a partly block diagram electrical schematic of the electronic safe arm device 12 and the capacitor exploding foil initiator device 16 is shown. A connector 80 provides interfacing for a control interface bus 82, an enable power line 84, and a high voltage monitor line 86 with wire line 220. Bus 82 interfaces with a safety control logic circuit 88 which controls an arm enable transistor 90 over a line 92, a generator transistor 94 over a line 96, and a pre-arm transistor 98 over a line 100. All three transistors 90, 94 and 98 are required to be actuated before a high voltage signal is generated. The high voltage signal is generated by a flyback transformer 102 connected between transistors 90 and 94. The output voltage at a line 104 is rectified by a diode 106. A feed back control circuit 107 is connected between resistors 112, 114 and safety control logic circuit 88.

A high voltage line 108 at the output of diode 106 and a case ground line 110 are connected to the parallel combination of resistor 50 and capacitor 48 in the capacitor exploding foil initiator device 16. One contact of switch 46 is connected to capacitor 48 and resistor 50 by line 108. The other contact of switch 46 is connected to electronic foil initiator 34 by a line 118. Electronic foil initiator 34 is connected by line 110 to capacitor 48 and resistor 50. Also referring to FIG. 3A electronic foil initiator 34 (i.e., printed wiring board) comprises a flat polyimide substrate (e.g., Dupont's Kapton ®) 150 having copper cladding 152 with a pre-etched copper bridge dimension 154. The copper bridge is electrically connected to switch 46 by line 118 and to case ground (line 110).

During use a high voltage (e.g., 3000 volts) is provided on line 108 from the electronic safe arm device 12 through pin 20 to socket 56. The voltage at socket 56 is present at tab 58 and therefore on wire 62 which is connected to resistor 50 and capacitor 48. Flyback transformer 102 stores energy during the on time of the transistors. When the transistors are turned off the energy stored in the transformer is transferred to the output as load current. The result is that the load capacitor 48 is charged to a voltage determined by the transformer windings. Once the voltage of the capacitor reaches the breakdown voltage of the switch 46, the energy stored in the capacitor is then discharged from the switch into the copper bridge of electronic foil initiator 34. The discharge of energy through the bridge results in a vaporization of the copper foil generating a polyimide flyer which accelerates toward the explosive pellet 30. The velocity of the flyer propagates a shock wave through the explosive pellet which causes detonation thereof. The detonation of the pellet initiates detonation cord 216 resulting in detonation of shaped charges 214 which creates the desired perforations in the casing, cement and formation, as described hereinbefore.

In accordance with an alternate embodiment of the present invention, overvoltage gap switch 46, capacitor 48 and resistor 50 are located in electronics and power supply module 218. Pellet assembly 30, disk 32, printed wiring board assembly 34 (i.e., the exploding foil initiator), and spring 40 are located in detonator module 216. This alternate embodiment may be preferred since detonator module 216 is expended during each use while electronics and power supply module 218 may be salvaged and reused. Accordingly less components would be expended during each use thereby reducing operation cost.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A perforation gun comprising:

a plurality of explosive charges;

a detonator cord connected to said explosive charges;

a capacitor exploding foil initiator comprising, (a) a capacitor, (b) a resistor connected in parallel with said capacitor, (c) over-voltage gap switch means connected to said capacitor and resistor, said over-voltage gap switch means for providing switch closure when a breakdown voltage of said over-voltage gap switch means is obtained, (d) electronic foil initiator means connected to said over-voltage gap switch means and to said capacitor and resistor, and (e) explosive pellet means in close proximity to said electronic foil initiator means, said electronic foil initiator means for detonating said explosive pellet means whereby said detonator cord resulting in detonation of said explosive charges.

2. The perforation gun of claim 1 wherein said capacitor is a low inductance capacitor.

3. The perforation gun of claim 1 wherein said electronic foil initiator means comprises:

a polyimide substrate; and a layer of copper foil having a copper bridge dimension, said layer of copper foil being disposed on said polyimide substrate, whereby a discharge of sufficient energy through said copper bridge dimension results in a vaporization of said copper foil generating a flyer comprised of at least a portion of said polyimide substrate.

4. A perforation gun comprising:

a support structure;

a plurality of explosive charges disposed on said support structure;

a detonator cord connected to said explosive charges;

a first housing connected to said support structure;

a second housing connected to said first housing;

electronic safe arm means disposed in said second housing; and a capacitor exploding foil initiator disposed in said first housing, said capacitor exploding foil initiator comprising, (a) a third housing disposed in said first housing, said third housing having first and second opposing ends, said first end having an opening therethrough, (b) an explosive pellet disposed in said opening of said third housing, (c) disk means disposed at said first end of said third housing over said opening, (d) electronic foil initiator means disposed within said third housing at said first end near said explosive pellet, said electronic foil initiator means for detonating said explosive pellet, (e) a capacitor disposed within said third housing, (f) a resistor disposed within said third housing and electrically connected in parallel with said capacitor, (g) electrical contact means disposed at said second end of said third housing, said electrical contact means for electrically connecting said capacitor exploding foil initiator to said electronic safe arm means, said electrical contact means electrically connected to said capacitor and resistor, and (h) over-voltage gap switch means disposed in said third housing and electrically connected to said capacitor and resistor and said electronic foil initiator means, said overvoltage of said over-voltage gap switch means for providing switch closure when a breakdown voltage of said over-voltage gap switch means is obtained; and means for securing said detonator cord at said disk means.

5. The perforation gun of claim 4 further comprising:

a fourth housing disposed within said third housing, said capacitor, resistor and over-voltage gap switch means disposed within said fourth housing.

6. The perforation gun of claim 5 further comprising:

spring means disposed between said fourth housing and said electronic foil initiator means for maintaining said electronic foil initiator means near to said explosive pellet.

7. The perforation gun of claim 5 wherein said resistor is disposed adjacent to said capacitor with said resistor being disposed within a recess of said fourth housing, and said over-voltage gap switch being disposed adjacent said capacitor.

8. The perforation gun of claim 4 wherein said electrical contact means comprises:

a conductive wire having one end thereof connected to said capacitor and resistor; and a socket having means for attaching the other end of said wire thereto, said socket being receptive to the external electrical connection for connection said capacitor exploding foil initiator to said electronic safe arm means.

9. The perforation gun of claim 4 wherein said capacitor is a low inductance capacitor.

10. The perforation gun of claim 4 wherein said electronic foil initiator means comprises:

a polyimide substrate;

a layer of copper foil having a copper bridge dimension, said layer of copper foil being disposed on said polyimide substrate, whereby a discharge of sufficient energy through said copper bridge dimension results in a vaporization of said copper foil generating a flyer comprised of at least a portion of said polyimide substrate.

11. The perforation gun of claim 4 wherein said explosive pellet comprises hexanitro stilbene.

12. A perforation gun including a plurality of explosive charges, a detonator cord connected to the explosive charges, and means for initiating the detonation cord causing detonation of the explosive charges, wherein the improvement comprises said means for initiating comprising;

a capacitor exploding foil initiator, said capacitor exploding foil initiator comprising, (a) a capacitor, (b) a resistor connected in parallel with said capacitor, (c) over-voltage gap switch means connected to said capacitor and resistor, said over-voltage gap switch means for providing switch closure when a breakdown voltage of said over-voltage gap switch means is obtained, (d) electronic foil initiator means connected to said over-voltage gap switch means and to said capacitor and resistor, and (e) explosive pellet means in close proximity to said electronic foil initiator means, said electronic foil initiator means for detonating said explosive pellet means whereby the detonator cord resulting in detonation of the explosive charges.

13. The perforation gun of claim 12 wherein said capacitor is a low inductance capacitor.

14. The perforation gun of claim 12 wherein said electronic foil initiator means comprises:

a polyimide substrate; and a layer of copper foil having a copper bridge dimension, said layer of copper foil being disposed on said polyimide substrate, whereby a discharge of sufficient energy through said copper bridge dimension results in a vaporization of said copper foil generating a flyer comprised of at least a portion of said polyimide substrate.

15. A perforation gun comprising:

a support structure;

a plurality of explosive charges disposed on said support structure;

a detonator cord connected to said explosive charges;

a first housing connected to said support structure;

a second housing connected to said first housing;

electronic safe arm means disposed in said second housing;

a third housing disposed in said first housing, said third housing having first and second opposing ends, said first end having an opening therethrough; and a capacitor exploding foil initiator comprising, (a) an explosive pellet disposed in said opening of said third housing, (b) disk means disposed at said first end of said third housing over said opening, (c) electronic foil initiator means disposed within said third housing at said first end near said explosive pellet, said electronic foil initiator means for detonating said explosive pellet, (d) a capacitor disposed within said second housing, (e) a resistor disposed within said second housing and electrically connected in parallel with said capacitor, (f) electrical contact means disposed at said second end of said third housing, said electrical contact means for electrically connecting said capacitor exploding foil initiator to said electronic safe arm means, and (g) over-voltage gap switch means disposed in said second housing and electrically connected to said capacitor and resistor and said electronic foil initiator means, said over-voltage of said over-voltage gap switch means for providing switch closure when a breakdown voltage of said over-voltage gap switch means is obtained; and means for securing said detonator cord at said disk means.

16. The perforation gun of claim 15 further comprising:

spring means disposed within said third housing for maintaining said electronic foil initiator means near to said explosive pellet.

17. The perforation gun of claim 15 wherein said capacitor is a low inductance capacitor.

18. The perforation gun of claim 15 wherein said electronic foil initiator means comprises:

a polyimide substrate; and a layer of copper foil having a copper bridge dimension, said layer of copper foil being disposed on said polyimide substrate, whereby a discharge of sufficient energy through said copper bridge dimension results in a vaporization of said copper foil generating a flyer comprised of at least a portion of said polyimide substrate.

19. The perforation gun of claim 15 wherein said explosive pellet comprises hexanitro stilbene.

20. A perforation gun including a plurality of explosive charges, a detonator cord connected to the explosive charges, safe arm means, and means for initiating the detonation cord causing detonation of the explosive charges, wherein the improvement comprises:

said safe and arm means including, (a) a capacitor, (b) a resistor connected in parallel with said capacitor, and (c) over-voltage gap switch means connected to said capacitor and resistor, said over-voltage gap switch means for providing switch closure when a breakdown voltage of said over-voltage gap switch is obtained; and said means for initiating comprising a exploding foil initiator, said exploding foil initiator comprising, (a) electronic foil initiator means connected to said over-voltage gap switch means and to said capacitor and resistor, and (b) explosive pellet means in close proximity to said electronic foil initiator means, said electronic foil initiator means for detonating said explosive pellet means whereby the detonator cord is initiated resulting in detonation of the explosive charges.

21. The perforation gun of claim 20 wherein said capacitor is a low inductance capacitor.

22. The perforation gun of claim 20 wherein said electronic foil initiator means comprises:

a polyimide substrate;

a layer of copper foil having a copper bridge dimension, said layer of copper foil being disposed on said polyimide substrate, whereby a discharge of sufficient energy through said copper bridge dimension results in a vaporization of said copper foil generating a flyer comprised of at least a portion of said polyimide substrate.

23. A detonating system comprising:

safe arm means, said safe and arm means including (a) a load capacitor, (b) a bleed resistor connected in parallel with said capacitor, and (c) over-voltage gap switch means connected to said load capacitor and bleed resistor, said over-voltage gap switch means for providing switch closure when a breakdown voltage of said over-voltage gap switch means is obtained; and initiator means, said initiator means including, (a) electronic foil initiator means connected to said over-voltage gap switch means and to said load capacitor and bleed resistor, and (b) explosive pellet means in close proximity to said electronic foil initiator means, said electronic foil initiator means for detonating said explosive pellet means resulting in detonation of an explosive.

24. The detonating system gun of claim 23 wherein said load capacitor is a low inductance capacitor.

25. The detonating system of claim 23 wherein said electronic foil initiator means comprises:

a polyimide substrate; and a layer of copper foil having a copper bridge dimension, said layer of copper foil being disposed on said polyimide substrate, whereby a discharge of sufficient energy through said copper bridge dimension results in a vaporization of said copper foil generating a flyer comprised of at least a portion of said polyimide substrate.

* * * * *